US009757730B2

(12) United States Patent
Harney et al.

(10) Patent No.: US 9,757,730 B2
(45) Date of Patent: Sep. 12, 2017

(54) PICK RETAINER

(75) Inventors: William L. Harney, Millersburg, KY (US); Jarrod Elliott, Augusta, KY (US)

(73) Assignee: Joy MM Delaware, Inc., Wilmington, DE (US)

( * ) Notice: Subject to any disclaimer, the term of this patent is extended or adjusted under 35 U.S.C. 154(b) by 933 days.

(21) Appl. No.: 13/177,161

(22) Filed: Jul. 6, 2011

(65) Prior Publication Data

US 2013/0008992 A1 Jan. 10, 2013

(51) Int. Cl.

| | |
|---|---|
| ***B02C 4/30*** | (2006.01) |
| ***B02C 4/10*** | (2006.01) |
| ***E21C 35/19*** | (2006.01) |

(52) U.S. Cl.

CPC ..... *B02C 4/30* (2013.01); *B02C 4/10* (2013.01); *E21C 35/19* (2013.01); *Y10T 29/49826* (2015.01)

(58) Field of Classification Search

CPC ..... B02C 18/18; B02C 18/28; B02C 18/06; B02C 18/2225; B02C 18/164; B02C 4/30; B02C 4/10; E21C 35/19; Y10T 29/49826; F16B 41/00

USPC .... 241/34, 91, 92, 294, 93, 277, 293, 189.1, 241/186.35; 299/107, 110, 113, 86, 91, 299/92, 93, 104; 144/218, 241

See application file for complete search history.

(56) References Cited

U.S. PATENT DOCUMENTS

| | | | | |
|---|---|---|---|---|
| 147,925 A | | 2/1874 | Firth | |
| 1,423,595 A | | 7/1922 | Bayles | |
| 1,613,693 A | | 1/1927 | Davis | |
| 2,332,408 A | * | 10/1943 | Stenger | E21C 25/36 411/24 |
| 2,700,549 A | | 1/1955 | Cornett | |
| 2,821,323 A | * | 1/1958 | Lee, II | F16L 55/13 220/233 |
| 2,893,298 A | | 7/1959 | Averette | |

(Continued)

FOREIGN PATENT DOCUMENTS

| | | |
|---|---|---|
| CA | 2708907 | 1/2011 |
| CN | 2184781 Y | 12/1994 |

(Continued)

OTHER PUBLICATIONS

GB1211763.6 United Kingdom Intellectual Property Office Search Report dated Oct. 29, 2012, 3 pages.

(Continued)

*Primary Examiner* — James S McClellan
*Assistant Examiner* — Peter Iannuzzi
(74) *Attorney, Agent, or Firm* — Michael Best & Friedrich LLP

(57) ABSTRACT

A breaker pick retainer system for a breaker includes a holder that defines a pick aperture and a pin aperture, and a breaker pick received in the pick aperture of the holder and including a pin receiving feature aligned with the pin aperture. The breaker pick retainer system including a pin received within the pin aperture of the holder and seated in the pin receiving feature of the breaker pick for maintaining the breaker pick within the holder. The breaker pick retainer system further including a resilient plug received within the pin aperture for sealing the pin aperture. The plug inhibits removal of the pin from the pin aperture.

36 Claims, 5 Drawing Sheets

(56) References Cited

U.S. PATENT DOCUMENTS 3,088,721 A * 5/1963 Krekeler ..... E21C 35/19 267/141
3,270,968 A * 9/1966 Hess ..... B02C 18/145 144/172
3,282,457 A * 11/1966 Sirois ..... 215/307
3,493,268 A * 2/1970 Bower, Jr. ..... 299/110
3,519,309 A 7/1970 Engle et al.
3,575,467 A * 4/1971 Davis ..... E21C 35/19 299/109
3,652,130 A 3/1972 Elders
3,679,265 A * 7/1972 Krekeler ..... 299/84.1
3,796,464 A * 3/1974 Hansen et al. ..... 299/104
4,045,086 A * 8/1977 Parkes ..... E21C 35/20 241/186.35
4,131,547 A * 12/1978 Michel et al. ..... 210/198.2
4,163,581 A * 8/1979 Krekeler ..... E21C 35/18 175/413
4,212,559 A * 7/1980 Persson ..... B23B 31/113 299/108
4,274,677 A * 6/1981 Proctor ..... E21C 35/183 175/413
4,275,929 A * 6/1981 Krekeler ..... E21C 35/18 299/102
4,462,638 A * 7/1984 DenBesten ..... E21C 35/19 175/354
4,571,966 A 2/1986 Lopez, Jr.
4,576,504 A 3/1986 Hartman
4,579,477 A 4/1986 Hartman
4,679,858 A 7/1987 Tank
4,684,176 A 8/1987 Den Besten et al.
4,761,900 A * 8/1988 Emrich ..... E02F 9/2841 37/457
4,865,080 A * 9/1989 Lundquist ..... 138/89
5,088,797 A 2/1992 O'Neil
5,114,082 A * 5/1992 Brundiek ..... B02C 4/305 241/121
5,261,499 A 11/1993 Grubb
5,318,351 A 6/1994 Walker
5,333,938 A 8/1994 Gale
5,447,208 A 9/1995 Lund et al.
5,810,102 A 9/1998 Stewart
5,944,057 A * 8/1999 Pierce ..... 138/89
D420,013 S 2/2000 Warren et al.
6,082,646 A * 7/2000 Clarke ..... B02C 17/22 241/182
6,393,739 B1 5/2002 Shamblin et al.
6,585,327 B2 7/2003 Sollami
6,904,983 B2 6/2005 Thigpen et al.
6,918,636 B2 7/2005 Dawood
7,270,379 B2 9/2007 Stehney
7,343,947 B1 * 3/2008 Sollami ..... E21C 35/197 144/241
7,380,889 B2 6/2008 Frear
7,600,544 B1 10/2009 Sollami
7,739,814 B2 * 6/2010 Carpenter ..... E02F 9/28 37/450
7,992,945 B2 8/2011 Hall et al.
8,201,892 B2 6/2012 Hall et al.
8,342,611 B2 1/2013 Hall et al.
8,424,974 B2 4/2013 Latham
2002/0167216 A1 11/2002 Sollami
2003/0234569 A1 12/2003 Dawood
2004/0187657 A1 * 9/2004 Smith ..... 82/123
2005/0127742 A1 * 6/2005 Erickson ..... E21C 35/1933 299/106
2007/0051022 A1 * 3/2007 Meyers ..... E02F 9/2825 37/455
2007/0079991 A1 4/2007 Cooley et al.
2008/0008523 A1 1/2008 Cadet
2010/0071961 A1 * 3/2010 Steel et al. ..... 175/375
2010/0253130 A1 10/2010 Sollami
2011/0148178 A1 6/2011 Lehnert et al.
2013/0008992 A1 1/2013 Harney et al.

FOREIGN PATENT DOCUMENTS

CN 101966477 A 2/2011
CN 201857970 6/2011
DE 29717023 1/1998
DE 102011051584 1/2013
GB 1081573 A 8/1967
GB 1587774 4/1981
GB 2208614 A 4/1989
WO 2004027272 A2 4/2004
WO 2005046875 A1 5/2005

OTHER PUBLICATIONS

P30700PL00/KJ Polish Search Report dated Oct. 25, 2012, 2 pages.
First Examination Report from the Australian Intellectual Property Office for Application No. 2011203507 dated Jun. 4, 2013 (3 pages).
Breaker Pick and Holder, available at least since Mar. 11, 2012 (some information redacted).
Office Action with English translation from the Patent Office of the Russian Federation for Application No. 2012128048 dated May 5, 2016 (16 pages).

* cited by examiner

PICK RETAINER

BACKGROUND

The present invention relates to feeder-breakers for the mining industry, and in particular an arrangement for coupling a pick to a feeder breaker.

Feeder breakers include a breaker for processing material that is traveling along a conveyor. Typically, the breaker includes an axle, a drum supported by and rotatable with the axle, and holders positioned about an exterior surface of the drum. Spiral roll pins are used to retain breaker picks within the tool holders. During use, the pins have a tendency to become lodged in place due to corrosion and compacting of material about the pin. When a breaker pick needs to be replaced, removal of the spiral roll pins is difficult and removal leads to damage to the holder or other components of the breaker.

SUMMARY

In one embodiment, the invention provides a breaker pick system for a feeder breaker that includes a drum and at least one holder rigidly coupled to the breaker. The breaker pick system includes an intermediate holder that is coupled to the holder. The intermediate holder includes a pick aperture that extends along a longitudinal axis of the intermediate holder and a pin aperture arranged transverse to the longitudinal axis. The pin aperture intersects the pick aperture. A breaker pick includes a first end that has a cutting surface and second end that defines a shaft received in the pick aperture of the intermediate holder and including a recess formed on an outer periphery of the shaft. When the breaker pick is received by the pick aperture, the recess is aligned with the pin aperture. A pin is received within the pin aperture of the intermediate holder and seated in the recess of the breaker pick for engaging the breaker pick. A resilient plug is received within the pin aperture for sealing the pin aperture, and the plug inhibits removal of the pin from the pin aperture.

In another embodiment the invention provides a feeder breaker that includes a frame defining an intake end and a discharge end. A conveyor is coupled to the frame for conveying material from the intake end to the discharge end and a breaker is coupled to the frame between the intake end and the discharge end. The breaker is configured to process material and includes a holder with a pick aperture extending along a longitudinal axis of the holder and a pin aperture transverse to and intersecting the pick aperture. A breaker pick includes a cutting portion, a shaft, and a recess formed in the shaft. When the shaft is retained within the pick aperture the recess is aligned with the pin aperture. The breaker further includes a retainer system for retaining the breaker pick in the holder. The retainer system includes a pin received in the pin aperture and the recess to engage the breaker pick, and a plug received in the pin aperture and sized to resiliently engage the holder. The plug substantially isolates the pin within the pin aperture and maintains the pin within the pin aperture.

In yet another embodiment, the invention provides a breaker pick system for a feeder breaker including a drum. The breaker pick system including a holder that is coupled to the drum and includes a pick aperture and a pin aperture intersecting the pick aperture. A breaker pick includes a cutting portion and a shaft positioned within the pick aperture. A pin receiving feature is formed on the shaft and is aligned with the pin aperture of the holder. A pin is slidingly received within the pin aperture and engages the pin receiving feature of the breaker pick to inhibit removal of the breaker pick from the holder. A plug is resiliently disposed within the pin aperture and engages the breaker pick to substantially seal the pin aperture and inhibit removal of the pin from the pin aperture.

In another embodiment, the invention provides a breaker pick retainer system for a breaker that includes a holder that defines a pick aperture and a pin aperture, and a breaker pick received in the pick aperture of the holder and including a pin receiving feature aligned with the pin aperture. The breaker pick retainer system includes a pin received within the pin aperture of the holder and seated in the pin receiving feature of the breaker pick for maintaining the breaker pick within the holder. The breaker pick retainer system further includes a resilient plug received within the pin aperture for sealing the pin aperture. The plug inhibits removal of the pin from the pin aperture.

In still another embodiment, the invention provides a method for coupling a breaker pick to a mining machine. The mining machine includes a holder that defines a pick aperture and a pin aperture intersecting the pick aperture. The breaker pick includes a cutting portion and a shaft that defines a pin receiving feature. The method includes inserting the shaft of the breaker pick into the pick aperture of the holder such that the pin receiving feature of the breaker pick aligns with the pin aperture of the holder, inserting a pin into the pin aperture wherein the pin is seated in the pin receiving feature such that the pin maintains the breaker pick within the holder, and inserting a resilient plug into the pin aperture such that the resilient plug maintains the pin within the pin aperture.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
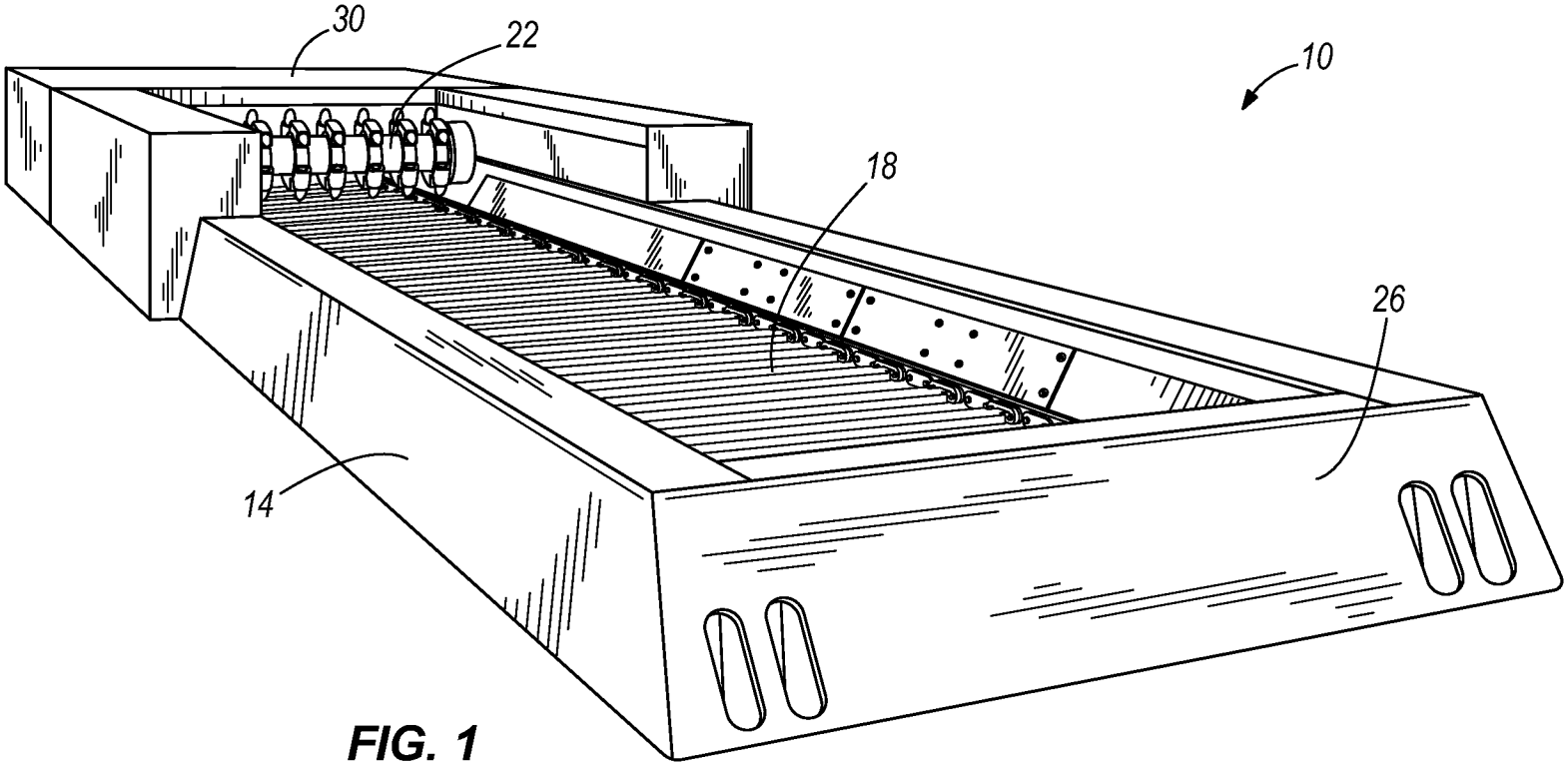
FIG. 1 is a perspective view of a feeder breaker.

FIG. 1 illustrates a feeder breaker 10 that operates to process material, such as coal, into a smaller and more workable size and to convey the material. The feeder breaker 10 includes a frame 14, a conveyor 18, and a breaker 22. The conveyor 18 moves material from an intake end 26 to a discharge end 30, and the breaker 22 processes the material therebetween.

Figure 2:
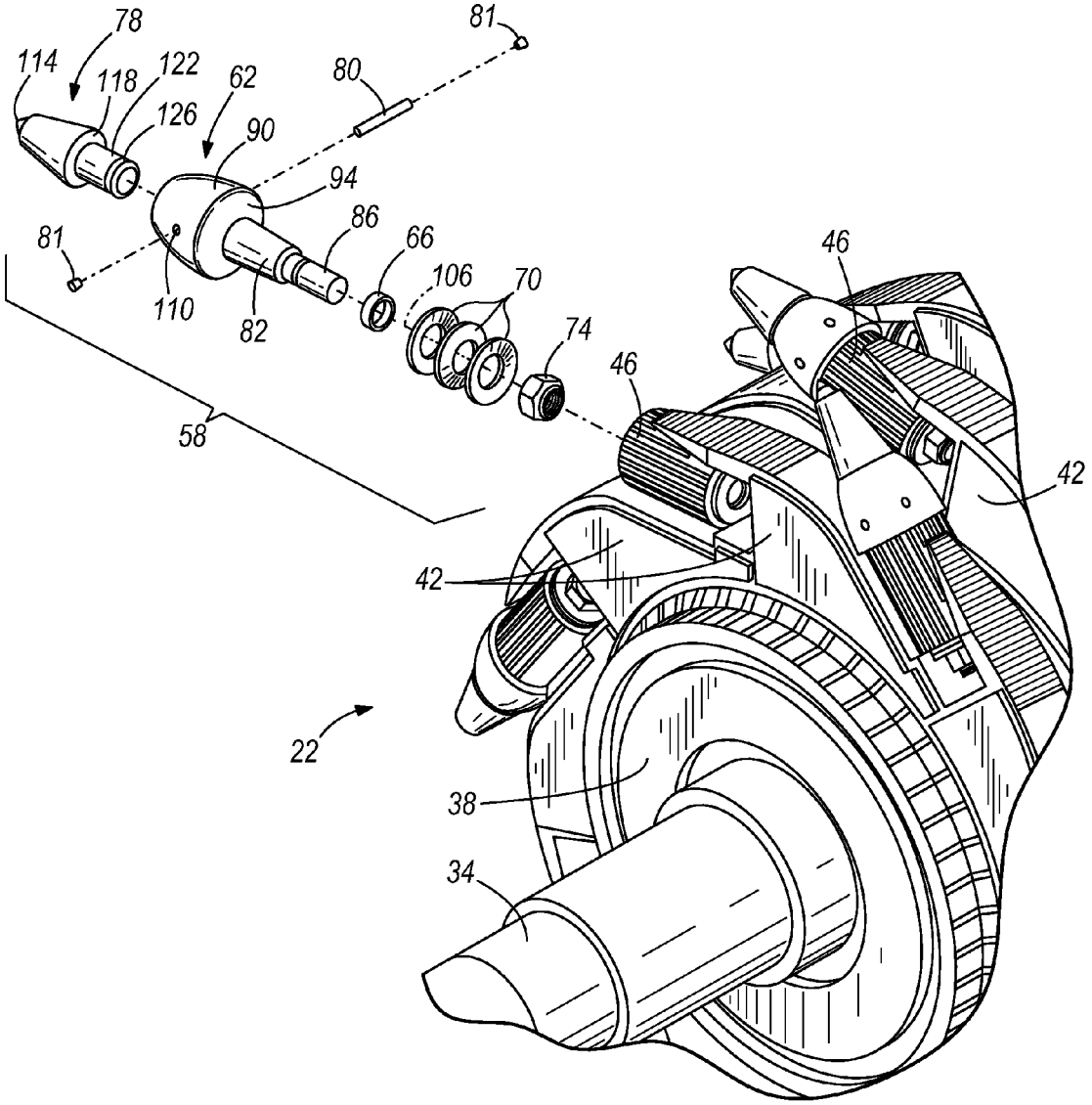
FIG. 2 is a partial perspective view of a breaker of the feeder breaker shown in FIG. 1, including an exploded view of a breaker pick assembly.
Figure 3:
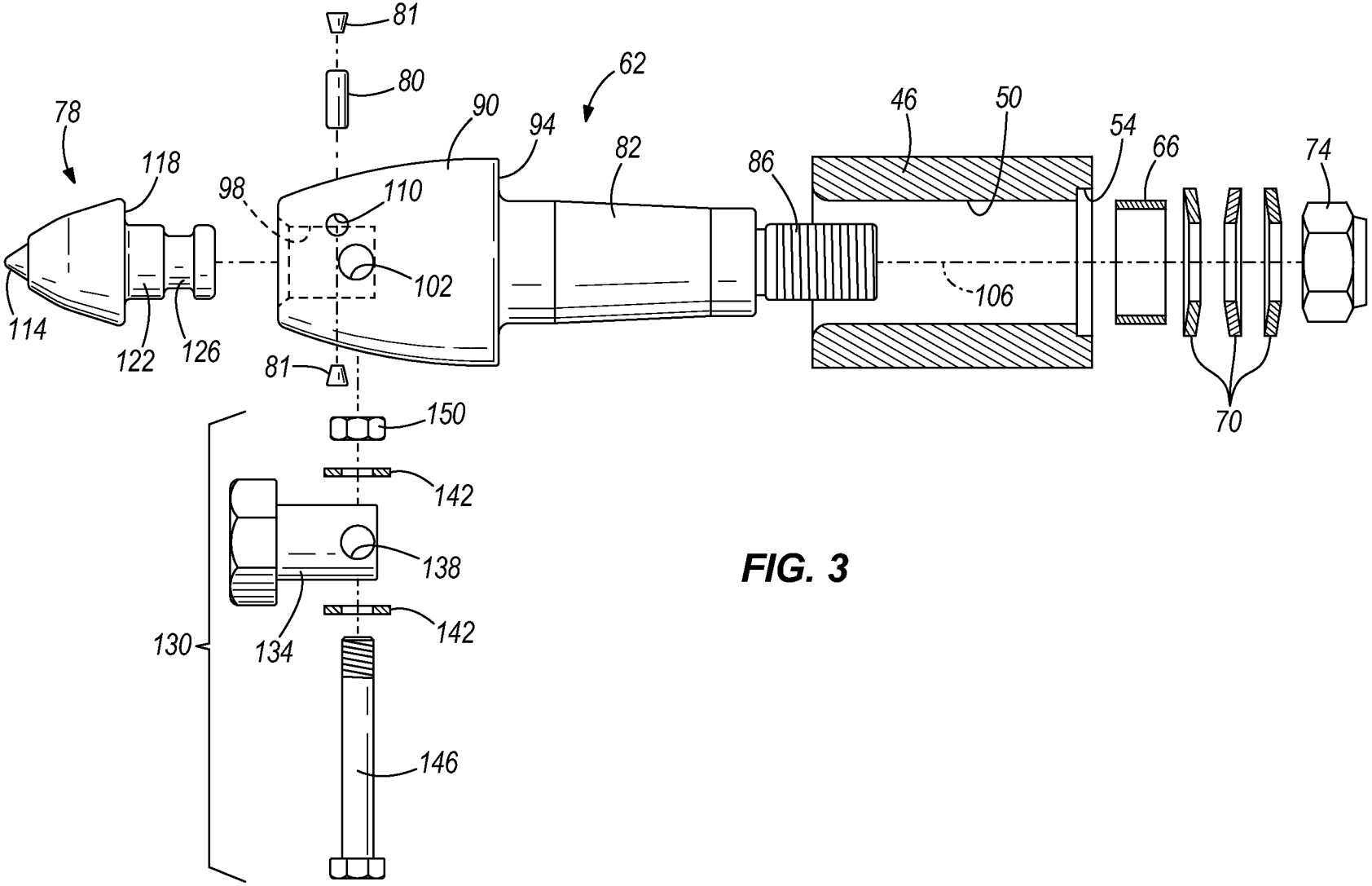
FIG. 3 is an exploded view of the breaker pick assembly shown in FIG. 2.

FIG. 2 illustrates a portion of the breaker 22. The breaker 22 includes an axle 34, a drum 38 supported by the axle 34 for rotation therewith, and projections 42 that extend radially outward from the drum 38. A holder 46 is coupled to each of the projections 42, and in the illustrated embodiment, the holder 46 is welded to the corresponding projection 42. Referring to FIG. 3, each of the holders 46 defines an interior surface 50 and a recessed portion 54 located at one of the holder end faces. In the illustrated embodiment, each of the holders 46 includes ribs formed on an exterior surface, which are formed by weld lines. In other embodiments, the structure of the holder 46 may be different or the holder 46 may be coupled to the breaker 22 in a different way (e.g., fasteners), as desired.

Figure 7:
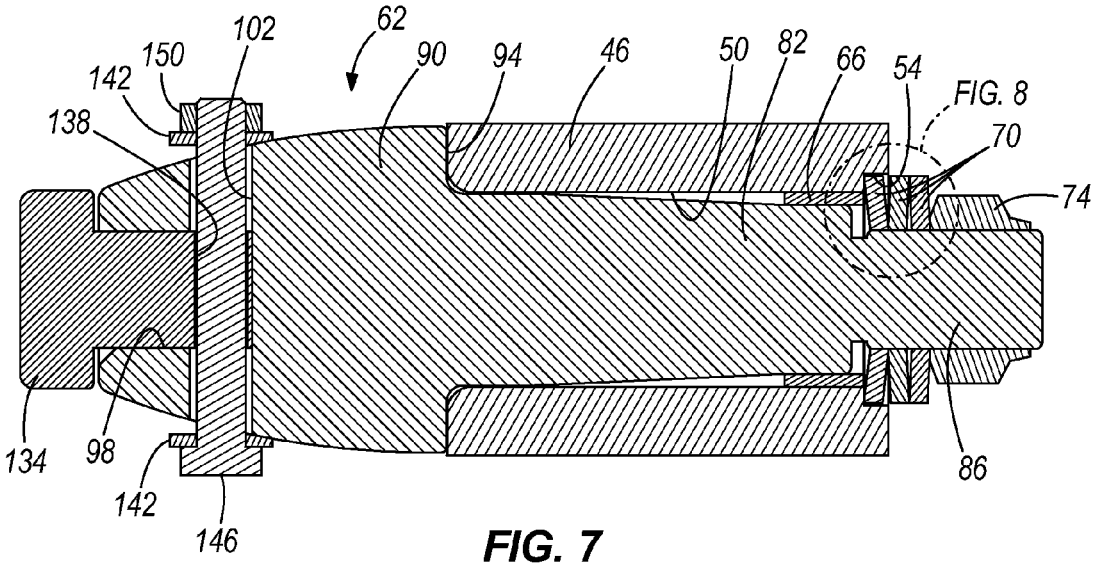
FIG. 7 is a sectional view of the breaker pick assembly shown in FIG. 2, and in an installation configuration.

A pick system 58 is coupled to each of the holders 46, which is part of the system for installing a breaker pick 78 to each holder 46. The pick system 58 forms a mining point for processing material, and the breaker pick 78 is a replaceable part that breaks up material being processed. The pick system 58 facilitates simple and easy removal and replacement of a pick. Referring to FIGS. 3 and 7, each of the pick systems 58 includes an intermediate holder 62, a spacer 66, a washer stack 70, a nut 74, the breaker pick 78, a pin 80, and two plugs 81.

The intermediate holder 62 includes a tapered shaft 82, a threaded end portion 86, a body portion 90, and a shoulder 94 formed between the tapered shaft 82 and the body portion 90. A pick aperture 98 is formed in an end face of the body portion 90 and is configured to receive the breaker pick 78. An installation aperture 102 is formed transverse to and intersecting a longitudinal axis 106 of the intermediate holder 62, and a pin aperture 110 is formed transverse to and offset from the longitudinal axis 106. The pin aperture 110 defines an aperture diameter. Both the installation aperture 102 and the pin aperture 110 intersect the pick aperture 98.

The spacer 66 has a cylindrical shape and is configured to be received between the tapered shaft 82 of the intermediate holder 62 and the interior surface 50 of the holder 46 when the intermediate holder 62 is installed in the holder 46 (FIG. 7). The washer stack 70 includes three washers positioned adjacent each other to form a spring, which is further described below. The nut 74 is configured to threadingly engage the threaded portion 86 of the intermediate holder 62.

The breaker pick 78 includes a mining point 114, a pick shoulder 118 transitioning to a pick shaft 122, and a pin receiving feature in the form of a groove or a pin recess 126 formed in the shaft 122. The pick shaft 122 is sized to be received within the pick aperture 98 of the intermediate holder 62. Further, the pin recess 126 is positioned on the pick shaft 122 such that when the breaker pick 78 is installed in the intermediate holder 62, the pin recess 126 is aligned with the pin aperture 110. In other constructions, the pin receiving feature could be an aperture, a depression, a blind hole, or another feature, as desired.

Figure 5:
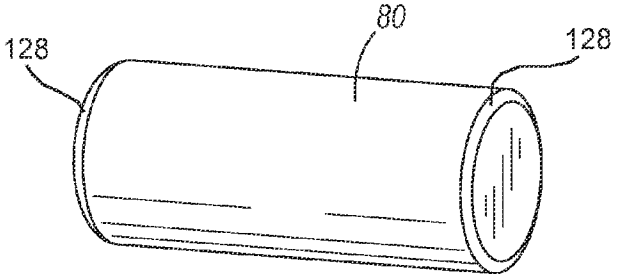
FIG. 5 is a perspective view of a pin for the breaker pick assembly.

Referring to FIG. 5, the illustrated pin 80 is a straight pin formed of turned, ground, and polished (TGP) 1045 steel. The pin 80 has a pin diameter of approximately 9 mm, which is less than the aperture diameter. The pin aperture 110 is sized such that the pin 80 slides freely within the pin aperture 110. The pin material resists reaction loads and shear failures that result from the impacts that the beaker pick 78 absorbs during normal use. The edges 128 of the pin 80 are filleted or rounded. In other embodiments, other suitable materials may be used or the pin aperture 110 and the pin 80 may be a different shape (e.g., square, rectangular, oval), as desired.

Figure 6:
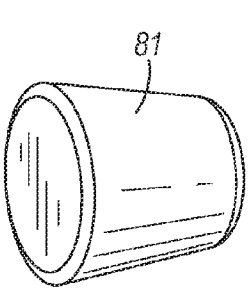
FIG. 6 is a perspective view of a plug for the breaker pick assembly.

Referring to FIG. 6, each of the plugs 81 has a generally frusto-conical shape, and is tapered from a first diameter of approximately 13 mm to a second diameter. The first diameter is greater than the diameter of the pin aperture 110 and the second diameter is smaller than the diameter of the pin aperture 110. In the illustrated embodiment, the plugs 81 are formed of a high temperature resilient rubber of 50 A-60 A durometer. The plugs 81 provide adequate toughness and resilience for retaining the pin 80 positioned in the pin aperture 110 of the intermediate holder 62. In other embodiments, the plugs 81 may be formed of other resilient or elastomeric materials, as desired.

FIG. 3 also illustrates an installation system 130 for installing the intermediate holder 62 into the holder 46. The illustrated installation system 130 provides for a consistent and proper installation of the intermediate holder 62. The installation system 130 includes an installation tool 134 with a hex head and a tool aperture 138, two washers 142, a bolt 146, and a nut 150. The installation tool 134 is sized to be received in the pick aperture 98. The tool aperture 138 is positioned to align with the installation aperture 102 of the intermediate holder 62 when the installation tool 134 is received within the pick aperture 98 of the intermediate holder 62. Operation of the installation system 130 will be discussed below.

Prior to installing the pick system 58, all internal surfaces of the holder 46, including the interior surface 50 and the recessed portion 54, are cleaned. Anti-seize compound (e.g., Never-Seez® brand compound) is applied to the threaded portion 86 and the holder shoulder 94 of the intermediate holder 62. Next, the shaft 82 of the intermediate holder 62 is inserted into the holder 46 until the holder shoulder 94 abuts an end face of the holder 46 opposite the recessed portion 54 (FIG. 7).

Figure 8:
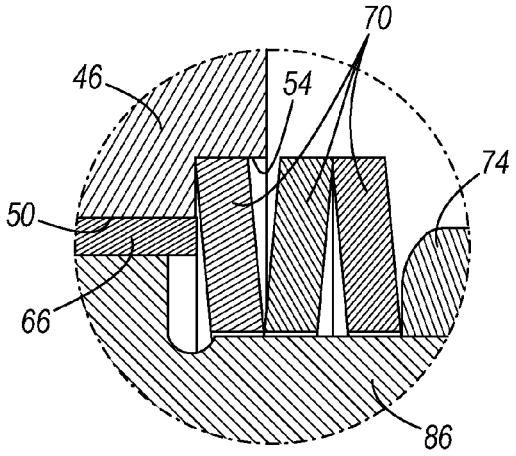
FIG. 8 is a detail view of FIG. 7 illustrating a set of uncompressed washers.

With the intermediate holder 62 positioned in the holder 46, anti-seize compound is applied to the spacer 66 and the spacer 66 is placed on the shaft 82 of the intermediate holder 62. The washer stack 70 is the aligned, as shown in FIG. 8, and installed on the shaft 82 of the intermediate holder 62 such that the washer stack 70 sits in the recessed portion 54 of the holder 46. The nut 74 is then threaded onto the threaded portion 86 of the intermediate holder 62.

FIG. 7 illustrates use of the installation system 130. The installation tool 134 is installed in the pick aperture 98 such that the tool aperture 138 aligns with the installation aperture 102. One of the washers 142 is positioned on the bolt 146, and the bolt 146 is inserted through the installation aperture 102 and the tool aperture 138. The second washer 142 is positioned on a portion of the bolt 146 exposed on the opposite side of the intermediate holder 62, and the nut 150 is threaded onto the bolt 146.

Figure 9:
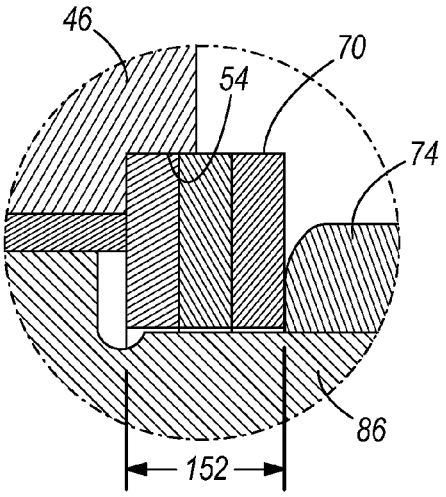
FIG. 9 is a detail view illustrating the washers of FIG. 8 compressed.

With continued reference to FIG. 7, two wrenches are then engaged with the hex head of the installation tool 134 and the nut 74, respectively. Initially, the washer stack 70 is in an uncompressed position shown in FIG. 8 and forms a spring. The wrenches are turned to tighten the nut 74 onto the threaded portion 86 of the intermediate holder 62. The nut 74 is tightened until the washer stack 70 is compressed or flattened, as shown in FIG. 9. The washer stack 70 acts in cooperation with the nut 74 to inhibit the nut 74 from unthreading (i.e., loosening). In other words, the washer stack 70 and nut 74 act as a lock nut. In the illustrated embodiment, the thickness of the washer stack 70 defines a distance 152. When the nut 74 is fully tightened the distance 152 is approximately 8 millimeters (5/16 inches). Additionally, the nut 74 is not to be tightened above 1400 lb/ft of torque. Preferrably, this tightness is applied by a torque wench to inhibit over tightening.

Figure 4:
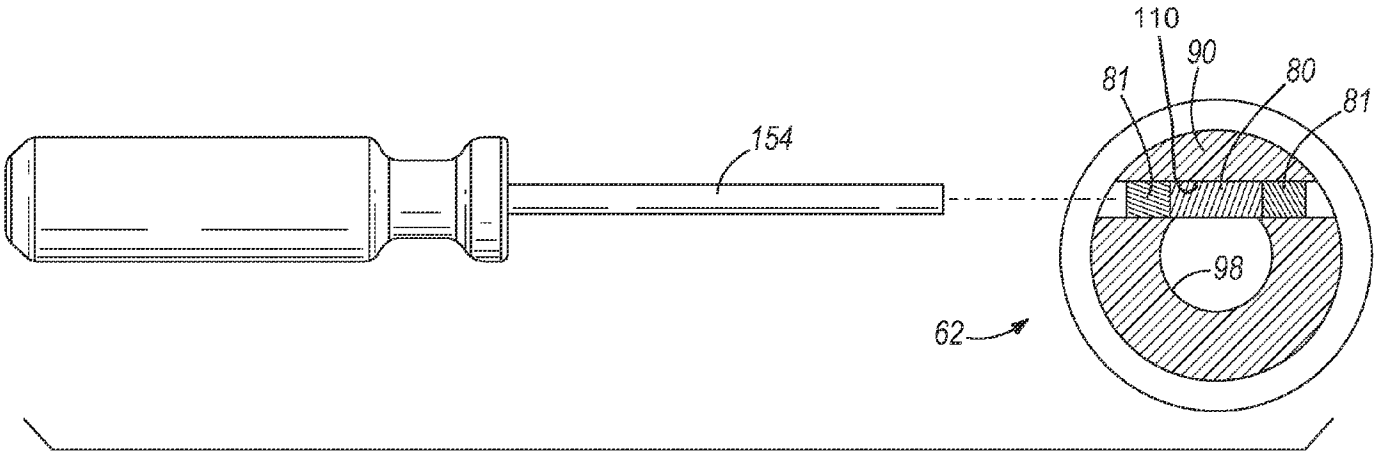
FIG. 4 is a sectional view of an assembled breaker pick assembly shown in FIG. 2.

Referring to FIG. 3, once the intermediate holder 62 is tightened and secured within the holder 46, the installation system 130 is removed from the intermediate holder 62. The shaft 122 of the breaker pick 78 is inserted into the pick aperture 98 such that the recess 126 aligns with the pin aperture 110. Referring to FIG. 4, a tool 154 is used to insert the first plug 81 into the pin aperture 110 from a first side of the intermediate holder 62 (as shown in FIG. 4). The narrow end of the plug 81 enters the pin aperture 110 first and the tool 154 pushes the plug 81 into the pin aperture 110 until the wide end of the plug 81 is positioned within the intermediate holder 62 (i.e., the plug 81 does not extend outside the intermediate holder 62).

Next, the pin 80 is inserted into the pin aperture 110 from the opposite side of the pin aperture 110. The pin 80 slides freely into the pin aperture 110 and into the recess 126 of the breaker pick 78. With the pin 80 in position, the second plug 81 is installed similar to the first plug 81, but from the opposite side, and pushed into the body portion 90 of the intermediate holder 62. When both plugs 81 are installed, the breaker pick system 58 is complete. The pin 80 is engaged between the body portion 90 of the intermediate holder 62 and the breaker pick 78. Such positive engagement holds the breaker pick 78 securely in position, while the pin 80 remains loose within the pin aperture 110.

To remove the breaker pick 78, the above installation process is reversed. First, the plugs 81 are removed, and the pin 80 is pushed out of the pin aperture 110, and therefore out of engagement with the breaker pick 78. With the used breaker pick 78 removed, a new breaker pick 78 may be reinserted into the holder 62

This breaker pick system 58 provides an end user with a system for replacing breaker picks on feeder breakers with relatively simple tooling. The resilient plugs 81 substantially protect the pin 80 from corrosion and material contact, which prolongs the life of the pin 80 and inhibits the breaker pick 78 from becoming stuck in the intermediate holder 62. The breaker pick system 58 and associated installation method reduces the time, potential damage to parts, and effort required to replace worn breaker picks. These advantages and others lead to savings and physical advantages for the end user. When installed, the breaker pick system 58 does not penalize machine performance and provides an added benefit for the end user.

Various features and advantages of the invention are set forth in the following claims.

What is claimed is:

1. A breaker pick system for a feeder breaker including a drum and at least one first holder rigidly coupled to the breaker, the breaker pick system comprising:

an intermediate holder configured to extend through the first holder, the intermediate holder including an end portion configured to extend from an end surface of the first holder, the intermediate holder further including a pick aperture extending along a longitudinal axis of the intermediate holder and a pin aperture arranged transverse to the longitudinal axis, the pick aperture positioned adjacent an end of the intermediate holder opposite the end portion, wherein the pin aperture intersects the pick aperture;

a breaker pick including a first end having a cutting surface and second end defining a shaft, the shaft received in the pick aperture of the intermediate holder and including a recess formed on an outer periphery of the shaft, wherein when the breaker pick is received by the pick aperture the recess is aligned with the pin aperture;

a pin received within the pin aperture of the intermediate holder and seated in the recess of the breaker pick for engaging the breaker pick, the pin including an end; and a solid resilient plug received within the pin aperture for sealing the pin aperture, wherein the plug is positioned adjacent the end of the pin to inhibit removal of the pin from the pin aperture.

2. The breaker pick system of claim 1, wherein the pin is a straight pin.

3. The breaker pick system of claim 1, wherein the pin aperture has a circular cross-section and defines an aperture diameter, and the pin is cylindrical and defines a pin diameter that is less than the aperture diameter.

4. The breaker pick system of claim 1, and further comprising a second solid resilient plug received within the pin aperture, wherein the plug is positioned at a first end of the pin and the second plug is positioned at a second end of the pin, the second end being opposite the first end.

5. The breaker pick system of claim 1, wherein the plug has a frustoconical shape such that the plug defines a first end and a second end having a narrower diameter than the first end, the second end of the plug being positioned adjacent the end of the pin.

6. The breaker pick system of claim 5, wherein the pin aperture defines an aperture diameter and at least a portion of the plug defines a plug diameter that is greater than the aperture diameter.

7. The breaker pick system of claim 1, wherein the plug is formed of a resilient rubber.

8. The breaker pick system of claim 7, wherein the resilient rubber has a hardness of about 50-60 durometer.

9. The breaker pick system of claim 7, wherein the resilient rubber is a high temperature resilient rubber.

10. The breaker pick system of claim 1, wherein the pin is formed of turned, ground, and polished 1045 steel.

11. A feeder breaker comprising:

a frame defining an intake end and a discharge end;

a conveyor coupled to the frame for conveying material from the intake end to the discharge end; and a breaker coupled to the frame between the intake end and the discharge end, the breaker configured to process material and the breaker including, a holder including a pick aperture extending along a longitudinal axis of the holder and a pin aperture transverse to and intersecting the pick aperture, a breaker pick including a cutting portion, a shaft, and a recess formed in the shaft, wherein when the shaft is retained within the pick aperture the recess is aligned with the pin aperture, and a retainer system for retaining the breaker pick in the holder, the retainer system including a pin received in the pin aperture and the recess to engage the breaker pick, and a solid plug received in the pin aperture and sized to resiliently engage the holder, wherein the plug has a frustoconical shape such that the plug defines a first end and a second end having a narrower diameter than the first end, the second end of the plug positioned adjacent an end of the pin, the plug substantially isolating the pin within the pin aperture and maintaining the pin within the pin aperture.

12. The feeder breaker of claim 11, wherein the pin aperture has a circular cross-section.

13. The feeder breaker of claim 11, wherein the plug is a first plug and further comprising a second solid plug received within the pin aperture, wherein the first plug is positioned at a first end of the pin and the second plug is positioned at a second end of the pin, the second end being opposite the first end.

14. The feeder breaker of claim 11, wherein the pin is in loose engagement with the pin aperture.

15. A breaker pick system for a feeder breaker, the feeder breaker including a drum having a first holder, the breaker pick system comprising:

an intermediate holder configured to extend through the first holder of the drum, the intermediate holder including an end portion configured to extend beyond an end surface of the first holder, the intermediate holder further including a pick aperture and a pin aperture intersecting the pick aperture, the pick aperture positioned adjacent an end of the intermediate holder opposite the end portion;

a breaker pick including a cutting portion and a shaft positioned within the pick aperture, a pin receiving feature formed on the shaft and aligned with the pin aperture of the holder;

a pin slidingly received within the pin aperture and engaging the pin receiving feature of the breaker pick to inhibit removal of the breaker pick from the holder; and a solid plug resiliently disposed within the pin aperture and engaging the breaker pick to substantially seal the pin aperture and inhibit removal of the pin from the pin aperture, the plug having a frustoconical shape such that the plug defines a first end and a second end having a narrower diameter than the first end, the second end of the plug positioned adjacent an end of the pin.

16. The breaker pick system of claim 15, wherein the pin aperture has a circular cross-section.

17. The breaker pick system of claim 15, wherein the pin receiving feature is a groove.

18. The breaker pick system of claim 15, wherein the pin aperture defines an aperture diameter, the plug defines a plug diameter, and the plug diameter is greater than the aperture diameter.

19. The breaker pick system of claim 15, wherein the pin is formed of turned, ground, and polished 1045 steel and the plug is formed of high temperature resilient rubber with a hardness of about 50-60 durometer.

20. A breaker pick retainer system for a breaker including a holder that defines a pick aperture and a pin aperture, and a breaker pick received in the pick aperture of the holder and including a pin receiving feature aligned with the pin aperture, the breaker pick retainer system comprising:

a pin received within the pin aperture of the holder and seated in the pin receiving feature of the breaker pick for maintaining the breaker pick within the holder, the pin including a first end, a second end, and a pin axis extending therebetween; and a solid resilient plug received within the pin aperture for sealing the pin aperture, the plug having a frustoconical shape defining a first end and a second end having a narrower diameter than the first end, the plug entirely positioned within the pin aperture such that the first end and the second end of the plug are positioned within the pin aperture, wherein the second end engages the first end of the pin to inhibit removal of the pin from the pin aperture.

21. The breaker pick retainer system of claim 20, wherein the pin is a straight pin.

22. The breaker pick retainer system of claim 20, wherein the pin is formed of turned, ground, and polished 1045 steel.

23. The breaker pick retainer system of claim 20, wherein the pin aperture defines an aperture diameter and the pin defines a pin diameter that is less than the aperture diameter.

24. The breaker pick retainer system of claim 20, wherein the plug is a first plug and inhibits removal of the pin in the direction of the first end of the pin, and further comprising a second solid resilient plug received within the pin aperture, wherein the second plug is positioned at the second end of the pin and inhibits removal of the pin from the pin aperture in the direction of the second end of the pin.

25. The breaker pick retainer system of claim 20, wherein the pin aperture defines an aperture diameter and at least a portion of the plug defines a plug diameter that is greater than the aperture diameter.

26. The breaker pick retainer system of claim 20, wherein the plug is formed of a resilient rubber.

27. The breaker pick retainer system of claim 26, wherein the resilient rubber has a hardness of about 50-60 durometer.

28. The breaker pick retainer system of claim 26, wherein the resilient rubber is a high temperature resilient rubber.

29. The breaker pick system of claim 1, wherein the pin aperture defines a longitudinal axis and at least one opening aligned with the longitudinal axis, and wherein at least a portion of the resilient plug is positioned between the end of the pin and the opening to prevent communication between the end of the pin and the opening.

30. The feeder breaker of claim 11, wherein the pin aperture defines a longitudinal axis and at least one opening aligned with the longitudinal axis, and wherein at least a portion of the plug is positioned between the end of the pin and the opening to prevent communication between the end of the pin and the opening.

31. The breaker pick system of claim 15, wherein the pin aperture defines a longitudinal axis and at least one opening aligned with the longitudinal axis, and wherein at least a portion of the plug is positioned between the end of the pin and the opening to prevent communication between the end of the pin and the opening.

32. The breaker pick system of claim 1, wherein the plug is positioned completely within the pin aperture.

33. The feeder breaker of claim 11, wherein the plug is positioned completely within the pin aperture.

34. The breaker pick system of claim 15, wherein the plug is positioned completely within the pin aperture.

35. The breaker pick system of claim 1, wherein the intermediate holder includes a shank positioned between the pick aperture and the end portion, and further comprising a spacer extending around a portion of the shank and configured to engage an interior surface of the first holder.

36. The breaker pick system of claim 1, wherein the end portion includes a threaded portion, and further comprising a nut threadably coupled to the threaded portion to secure the intermediate holder against movement relative to the first holder.

* * * * *